US006705955B2

(12) United States Patent
Isogawa et al.

(10) Patent No.: US 6,705,955 B2
(45) Date of Patent: Mar. 16, 2004

(54) THREAD WOUND GOLF BALL

(75) Inventors: Kazuhiko Isogawa, Kobe (JP); Akira Kato, Kobe (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 16 days.

(21) Appl. No.: 09/931,027

(22) Filed: Aug. 17, 2001

(65) Prior Publication Data

US 2002/0045494 A1 Apr. 18, 2002

(30) Foreign Application Priority Data

Aug. 28, 2000 (JP) ..... 2000-257445

(51) Int. Cl.[7] ..... A63B 37/06
(52) U.S. Cl. ..... 473/357
(58) Field of Search ..... 473/356–366

(56) References Cited

U.S. PATENT DOCUMENTS 5,445,387 A 8/1995 Maruko et al.
5,607,366 A * 3/1997 Yokota et al. ..... 273/DIG. 22
5,782,707 A * 7/1998 Yamagishi et al. ..... 473/373
5,810,677 A * 9/1998 Maruko et al. ..... 264/28
5,820,487 A * 10/1998 Nakamura et al. ..... 473/373
5,830,085 A * 11/1998 Higuchi et al. ..... 473/373
5,848,942 A * 12/1998 Kato ..... 473/365

FOREIGN PATENT DOCUMENTS

JP A-9-271537 10/1997
JP B2-2715885 11/1997

* cited by examiner

*Primary Examiner*—Mark S. Graham
*Assistant Examiner*—Raeann Gorden
(74) *Attorney, Agent, or Firm*—Birch, Stewart, Kolasch & Birch, LLP

(57) ABSTRACT

The present invention provides a thread wound golf ball having long flight distance, while maintaining the characteristics peculiar to the conventional thread wound golf ball, i.e. good shot feel. The present invention related to a thread wound golf ball comprising a solid center, a thread rubber layer formed on the solid center, and a cover covering the thread rubber layer, wherein the solid center has a diameter of 30 to 38 mm and a surface hardness in JIS-C hardness of 65 to 90, the surface hardness is higher than a center hardness in JIS-C hardness of the solid center by not less than 12, the cover is formed from a base resin mainly comprising ionomer resin, and has a flexural modulus of 200 to 600 MPa and a Shore D hardness of 60 to 80.

1 Claim, 1 Drawing Sheet

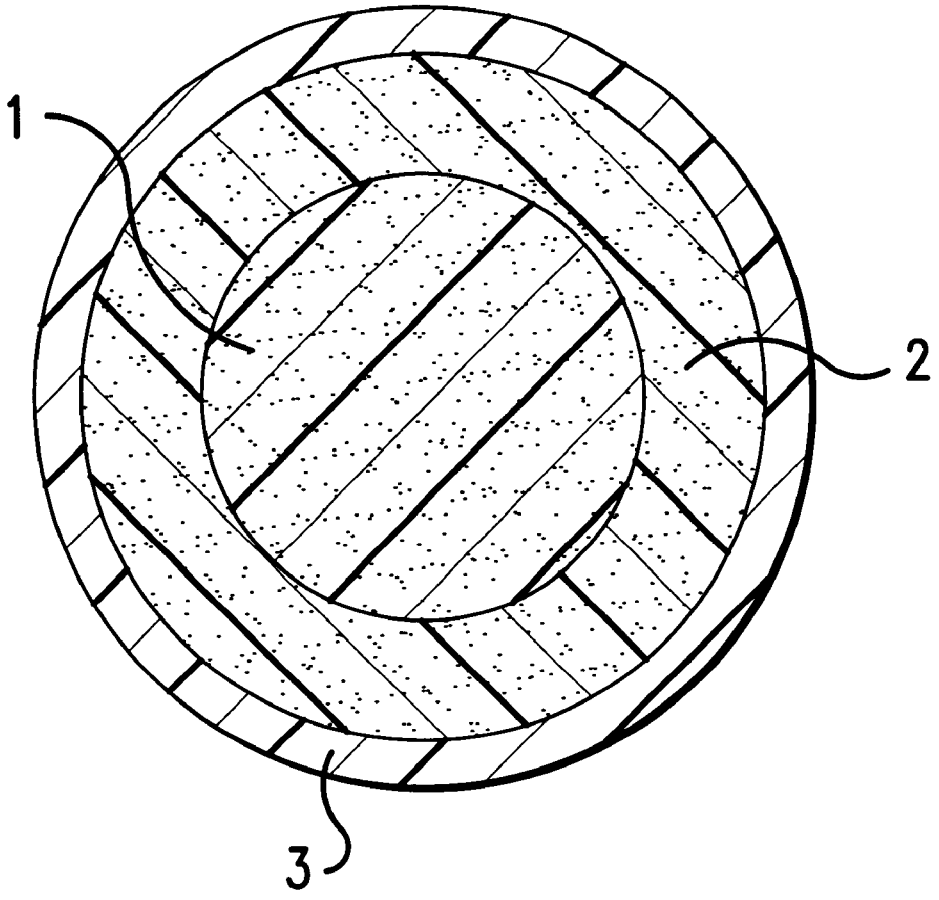
1
2
3

THREAD WOUND GOLF BALL

FIELD OF THE INVENTION

The present invention relates to a thread wound golf ball. More particularly, it relates to a thread wound golf ball having long flight distance, while maintaining the characteristics peculiar to the conventional thread wound golf ball, i.e. good shot feel.

BACKGROUND OF THE INVENTION

Many golf balls are commercially selling, but they are typically classified into solid golf balls such as two-piece golf ball, three-piece golf ball and the like, and thread wound golf balls. The solid golf ball consists of a solid core of molded rubber material and a cover of thermoplastic resin (e.g. ionomer resin) covering on the solid core. The thread wound golf ball consists of a solid or liquid center, a thread wound layer formed on the center and a cover of ionomer resin or balata etc. having a thickness of 1 to 2 mm covering on the thread wound layer.

The thread wound golf ball, when compared with the solid golf ball such as two-piece golf ball, has better shot feel at the time of hitting and better controllability at approach shot. The thread wound golf ball is generally approved of or employed by high level golfers, especially professional golfers, who regard the characteristics as most important. However, the thread wound golf ball is inferior in flight distance to the solid golf ball, because the thread wound golf ball has large spin amount and small launch angle.

In the thread wound golf balls, there are two types, such as one comprising a solid center formed from integrally molded rubber material and the other comprising a liquid center composed of a hollow rubber sphere and liquid encapsulated in the sphere. Among them, a thread wound golf ball comprising a liquid center and a balata (trans-polyisoprene) cover is particularly approved of or employed by high level golfers, especially professional golfers, because of good shot feel and excellent controllability at approach shot. The thread wound golf ball comprising a solid center, when compared with the thread wound golf ball comprising a liquid center, has excellent flight distance, because the rebound characteristics of the center also have an effect on the rebound characteristics of the golf ball itself. However, the thread wound golf ball is generally inferior in flight distance to the solid golf ball as described above, and it is required to improve the flight distance, while maintaining the characteristics peculiar to the thread wound golf ball.

In order to solve the problem, a thread wound golf ball comprising a solid center, which has further excellent shot feel and controllability and long flight distance mainly by adjusting the hardness distribution of the solid center to suitable range, has been proposed in Japanese Patent Kokai Publication No. 271537/1997, Japanese Patent No. 2715885 and the like.

However, the thread wound golf ball, which has sufficient flight distance as long as solid golf balls, while maintaining the advantage of good shot feel and excellent controllability peculiar to the thread wound golf balls, has not been obtained. Therefore the thread wound golf ball having further excellent shot feel and controllability and long flight distance is required.

OBJECTS OF THE INVENTION

A main object of the present invention is to provide a thread wound golf ball, of which flight distance is improved, while maintaining soft and good shot feel.

According to the present invention, the object described above has been accomplished by employing a thread wound core which comprises a solid center, and adjusting a diameter, surface hardness (JIS-C hardness) and hardness distribution of the solid center, and a flexural modulus and Shore D hardness of the cover to a specified range, thereby providing a thread wound golf ball, of which the flight distance is improved, while maintaining soft and good shot feel.

SUMMARY OF THE INVENTION

The present invention provides a thread wound golf ball comprising a solid center, a thread rubber layer formed on the solid center, and a cover covering the thread rubber layer, wherein the solid center has a diameter of 30 to 38 mm and a surface hardness in JIS-C hardness of 65 to 90, the surface hardness is higher than a center hardness in JIS-C hardness of the solid center by not less than 12, the cover is formed from a base resin mainly comprising ionomer resin, and has a flexural modulus of 200 to 600 MPa and a Shore D hardness of 60 to 80.

In order to put the present invention into a more suitable practical application, it is desired that the ionomer resin used for the cover have an acid content of 12 to 30% by weight, and 5 to 80% of carboxyl groups in the ionomer resin are neutralized with metal ion.

BRIEF DESCRIPTION OF THE DRAWINGS

The FIG. depicts in cross-section the golf ball of the present invention.

DETAILED DESCRIPTION OF THE INVENTION

The thread wound golf ball of the present invention will be explained in detail hereinafter in relation to the Figure. The golf ball of the present invention comprises a solid center 1, a thread rubber layer 2 formed on the solid center and a cover 3 formed on the thread rubber layer. The solid center 1 is formed from a rubber composition comprising a base rubber, a co-crosslinking agent, an organic peroxide, a filler and the like.

The base rubber may be natural rubber and/or synthetic rubber, which has been conventionally used for solid golf balls. Preferred is high-cis polybutadiene rubber containing a cis-1,4 bond of not less than 40%, preferably not less than 80%. The polybutadiene rubber may be mixed with natural rubber, polyisoprene rubber, styrene-butadiene rubber, ethylene-propylene-diene rubber (EPDM), and the like.

Examples of the co-crosslinking agents include a metal salt of α,β-unsaturated carboxylic acid, particularly mono- or di-valent metal salts, such as zinc or magnesium salts of α,β-unsaturated carboxylic acids having 3 to 8 carbon atoms (e.g. acrylic acid, methacrylic acid, etc.). The preferred co-crosslinking agent is zinc acrylate because it imparts high rebound characteristics to the resulting golf ball. The amount of the co-crosslinking agent may be 10 to 40 parts by weight, preferably 15 to 35 parts by weight, based on 100 parts by weight of the base rubber. When the amount of the co-crosslinking agent is larger than 40 parts by weight, the center is too hard, and the shot feel of the resulting golf ball is poor. On the other hand, when the amount of the co-crosslinking agent is smaller than 10 parts by weight, the center is too soft, and the rebound characteristics are degraded, which reduces the flight distance.

Examples of the organic peroxides, which acs as a crosslinking agent or hardener, include dicumyl peroxide, 1,1-bis(t-butylperoxy)-3,3,5-trimethylcyclohexane, 2,5-dimethyl-2,5-di(t-butylperoxy)-hexane, di-t-butyl peroxide and the like. The preferred organic peroxide is dicumyl peroxide. The amount of the organic peroxide is from 0.5 to 2.0 parts by weight, preferably 0.8 to 1.5 parts by weight, based on 100 parts by weight of the base rubber. When the amount of the organic peroxide is smaller than 0.5 parts by weight, the center is too soft, and the rebound characteristics are degraded, which reduces the flight distance. On the other hand, when the amount of the organic peroxide is larger than 2.0 parts by weight, the center is too hard, and the shot feel is poor.

Examples of the fillers, which can be used for a core of golf balls, include for example, inorganic filler (such as zinc oxide, barium sulfate, calcium carbonate, and the like), high specific gravity metal powder filler (such as tungsten powder, molybdenum powder, and the like), and the mixture thereof. The amount of the filler in the inner center 1 is from 20 to 70 parts by weight, preferably 25 to 60 parts by weight, based on 100 parts by weight of the base rubber. When the amount of the filler is smaller than 20 parts by weight, the center is too light, and the weight of the resulting golf ball is too small. On the other hand, when the amount of the filler is larger than 70 parts by weight, the center is too heavy, and the weight of the resulting golf ball is too large.

In the golf ball of the present invention, the rubber composition for the solid center can contain other components, which have been conventionally used for preparing a core of solid golf balls, such as antioxidant or peptizing agent. If used, the amount of the antioxidant is preferably 0.2 to 0.5 parts by weight, based on 100 parts by weight of the base rubber.

The solid center is obtained by mixing the rubber composition using a proper mixer such as a kneader and a mixing roll, followed by vulcanizing and press-molding the mixture in a mold. The vulcanization condition is not limited as long as the solid center has the following characteristics, but the vulcanization may be conducted at 130 to 240° C. and 2.9 to 11.8 MPa for 15 to 60 minutes. The vulcanization may be conducted in two or more stages of the temperature.

In the golf ball of the present invention, it is required for the solid center to have a diameter of 30 to 38 mm, preferably 32 to 38 mm, more preferably 34 to 37 mm. When the diameter of the solid center is smaller than 30 mm, the spin amount at the time of hitting increases, which reduces the flight distance. On the other hand, when the diameter of the solid center is larger than 38 mm, the thread rubber layer is too thin. Therefore, rebound characteristics as technical effects accomplished by the presence of the thread rubber layer are not sufficiently obtained, which reduces the flight distance.

In the golf ball of the present invention, it is required for the solid center to have a surface hardness in JIS-C hardness (which is substantially the same as Shore C hardness) of 65 to 90, preferably 70 to 87, more preferably 75 to 85. When the hardness is smaller than 65, the solid center is too soft, and the resulting golf ball does not have a desired hardness and the rebound characteristics are degraded. On the other hand, when the hardness is larger than 90, the solid center is too hard, and the shot feel of the resulting golf ball is poor.

In the golf ball of the present invention, it is required for the solid center to have the surface hardness higher than a center hardness in JIS-C hardness of the solid center by not less than 12, preferably not less than 13, more preferably not less than 14. When the hardness difference is too large, the rebound characteristics of the solid center are degraded, which reduces the flight distance of the resulting golf ball. Therefore the hardness difference is within the range of preferably not more than 30, more preferably not more than 28.

In the golf ball of the present invention, it is desired for the solid center to have the center hardness in JIS-C hardness of 50 to 75, preferably 55 to 70, more preferably 60 to 68. When the center hardness is smaller than 50, the solid center is too soft, and the resulting golf ball does not have a desired hardness and the rebound characteristics are degraded. On the other hand, when the center hardness is larger than 75, the solid center is too hard, and the shot feel of the resulting golf ball is poor. The term "a center hardness of a solid center" as used herein refers to the hardness, which is determined by cutting the solid center into two equal parts and then measuring a JIS-C hardness at its center point in section. The thread rubber layer is then formed on the solid center.

The thread rubber used for winding around the solid center may be of the same kind which is conventionally used in thread wound layers in thread wound golf balls; e.g., it can be obtained by vulcanizing a rubber composition in which natural rubber or natural rubber and synthetic polyisoprene have been compounded with sulfur, a vulcanization aid, vulcanization accelerator, antioxidant and the like. The thread rubber layer is formed on the solid center by conventional methods which have used for preparing the thread wound core of the thread wound golf balls. The thread rubber layer has a thickness of 1.0 to 4.0 mm, preferably 1.2 to 3.5 mm. When the thickness of the thread rubber layer is smaller than 1.0 mm, the thread rubber layer is too thin to exhibit sufficient impact relaxation, and the shot feel is poor. On the other hand, when the thickness is larger than 4.0 mm, the spin amount at the time of hitting increases, which reduces the flight distance. The cover is then formed on the thread rubber layer.

In the golf ball of the present invention, it is required for the cover to have a flexural modulus of 200 to 600 MPa, preferably 220 to 550 MPa, more preferably 240 to 500 MPa. When the flexural modulus is lower than 200 MPa, the rebound characteristics of the resulting golf ball are not only degraded, but the spin amount at the time of hitting is also high, which reduces the flight distance. On the other hand, when the flexural modulus is higher than 600 MPa, the shot feel of the resulting golf ball is poor.

In the golf ball of the present invention, it is required for the cover to have a Shore D hardness of 60 to 80, preferably 61 to 77, more preferably 62 to 74. When the hardness is smaller than 60, the rebound characteristics of the resulting golf ball are not only degraded, but the spin amount at the time of hitting is also high, which reduces the flight distance. On the other hand, when the hardness is larger than 80, the shot feel of the resulting golf ball is poor.

In the golf ball of the present invention, it is required for the cover to be formed from a base resin mainly comprising ionomer resin. The ionomer resin used in the present invention is not limited, but includes a copolymer of ethylene and α,β-unsaturated carboxylic acid, of which at least a portion of carboxylic acid groups is neutralized with metal ion; a terpolymer of ethylene, α,β-unsaturated carboxylic acid and α,β-unsaturated carboxylic acid ester, of which at least a portion of carboxylic acid groups is neutralized with metal ion; or mixtures thereof. Examples of the α,β-unsaturated carboxylic acid in the ionomer, for example, include acrylic acid, methacrylic acid, fumaric acid, maleic acid, crotonic acid and the like. Preferred are acrylic acid and methacrylic acid. Examples of the α,β-unsaturated carboxylic acid ester in the ionomer, for example, include methyl ester, ethyl ester, propyl ester, n-butyl ester and isobutyl ester of acrylic acid, methacrylic acid, fumaric acid, maleic acid and the like. Preferred are acrylic acid esters and methacrylic acid esters. Examples of the metal ions, which neutralizes a portion of carboxylic acid groups of the copolymer or terpolymer, include a sodium ion, a potassium ion, a lithium ion, a magnesium ion, calcium ion, a zinc ion, a barium ion, an aluminum ion, a tin ion, a zirconium ion, a cadmium ion and the like. Preferred are sodium ion, zinc ion, magnesium ion and the like, in view of rebound characteristics, durability and the like.

In the cover of the golf ball of the present invention, it is desired that 5 to 80%, preferably 10 to 70%, more preferably 20 to 60% of carboxylic acid groups in the ionomer resin be neutralized with metal ion. When the ionomer resin, of which less than 5% of carboxylic acid groups in the ionomer resin are neutralized with metal ion, is used for the cover, the cover is too soft, and the resulting golf ball does not have a desired hardness and the rebound characteristics are degraded. On the other hand, when the ionomer resin, of which more than 80% of carboxylic acid groups in the ionomer resin are neutralized with metal ion, is used for the cover, the cover is too hard, and the shot feel of the resulting golf ball is poor.

In the cover of the golf ball of the present invention, it is desired for the ionomer resin to have an acid content of 12 to 30% by weight, preferably 13 to 26% by weight, more preferably 14 to 22% by weight. When the acid content is smaller than 12% by weight, the rebound characteristics of the resulting golf ball are degraded, which reduces the flight distance. On the other hand, when the acid content is larger than 30% by weight, the shot feel of the resulting golf ball is poor.

The ionomer resin is not limited, but examples thereof will be shown by trade names. Examples of the ionomer resin, which is commercially available from Du Pont-Mitsui Polychemicals Co., Ltd., include Hi-milan 1555, Hi-milan 1557, Hi-milan 1605, Hi-milan 1652, Hi-milan 1705, Hi-milan 1706, Hi-milan 1707, Hi-milan 1855, Hi-milan 1856 and the like. Examples of the ionomer resins, which is commercially available from Du Pont Co., include Surlyn 8140, Surlyn 9120, Surlyn 8945, Surlyn 9945, Surlyn AD8511, Surlyn AD8512, Surlyn AD8542, Surlyn 6320 and the like. Examples of the ionomer resin, which is commercially available from Exxon Chemical Co., include Iotek 7010, Iotek 8000, and the like. The ionomers may each be used alone or in combinations of two or more thereof.

As the materials suitably used in the cover of the present invention, the above ionomer resin may be used alone, but the ionomer resin may be used in combination with at least one of thermoplastic elastomer, diene block copolymer and the like.

Examples of the thermoplastic elastomers include polyamide thermoplastic elastomer, which is commercially available from Toray Co., Ltd. under the trade name of "Pebax" (such as "Pebax 2533"); polyester thermoplastic elastomer, which is commercially available from Toray-Do Pont Co., Ltd. under the trade name of "Hytrel" (such as "Hytrel 3548", "Hytrel 4047"); polyurethane elastomer, which is commercially available from Takeda Bardishe Co., Ltd. under the trade name of "Elastollan" (such as "Elastollan ET880"); and the like.

The diene block copolymer is a block copolymer or partially hydrogenated block copolymer having double bond derived from conjugated diene compound. The base bock copolymer is block copolymer composed of block polymer block A mainly comprising at least one aromatic vinyl compound and polymer block B mainly comprising at least one conjugated diene compound. The partially hydrogenated block copolymer is obtained by hydrogenating the block copolymer. Examples of the aromatic vinyl compounds comprising the block copolymer include styrene, α-methyl styrene, vinyl toluene, p-t-butyl styrene, 1,1-diphenyl styrene and the like, or mixtures thereof. Preferred is styrene. Examples of the conjugated diene compounds include butadiene, isoprene, 1,3-pentadiene, 2,3-dimethyl-1,3-butadiene and the like, or mixtures thereof. Preferred are butadiene, isoprene and combinations thereof. Examples of the diene block copolymers include an SBS (styrene-butadiene-styrene) block copolymer having polybutadiene block with epoxy groups or SIS (styrene-isoprene-styrene) block copolymer having polyisoprene block with epoxy groups and the like. Examples of the diene block copolymers which is commercially available include the diene block copolymers, which are commercially available from Daicel Chemical Industries, Ltd. under the trade name of "Epofriend" (such as "Epofriend A1010"), the diene block copolymers, which are commercially available from Kuraray Co., Ltd. under the trade name of "Septon" (such as "Septon HG-252") and the like.

The amount of the thermoplastic elastomer or diene block copolymer is 0 to 60 parts by weight, preferably 10 to 40 parts by weight, based on 100 parts by weight of the base resin for the cover. When the amount is larger than 60 parts by weight, the cover is too soft and the rebound characteristics are degraded, or the compatibility with the ionomer resin is degraded and the durability is degraded.

In the golf ball of the present invention, the resin composition for the cover may optionally contain the same fillers as used in the solid center, pigments (such as titanium dioxide, etc.), and the other additives (such as dispersants, antioxidants, UV absorbers, photostabilizers and fluorescent agents or fluorescent brighteners, etc.), in addition to the resin component, as long as the addition of the additives does not deteriorate the desired performance of the golf ball cover, but an amount of the pigment is preferably from 1.0 to 6.0 parts by weight based on 100 parts by weight of the cover base resin.

The cover of the present invention may be formed by conventional methods, which have been known to the art and used for forming the cover of the golf balls. For example, there can be used a method comprising molding the cover composition into a semi-spherical half-shell in advance, covering the thread wound core with the two half-shells, followed by pressure molding at 130 to 170° C. for 1 to 5 minutes, or a method comprising injection molding the cover composition directly on the thread wound core to cover it.

It is desired for the cover to have a thickness of 1.0 to 5.0 mm, preferably 1.4 to 4.6 mm, more preferably 1.4 to 2.5 mm. When the thickness of the cover is smaller than 1.0 mm, the cover is too thin, and the durability is degraded and the rebound characteristics are degraded. On the other hand, when the thickness is larger than 5.0 mm, the shot feel is poor.

At the time of molding the cover, many depressions called "dimples" may be optionally formed on the surface of the golf ball. Furthermore, paint finishing or marking with a stamp may be optionally provided after the cover is molded for commercial purposes.

EXAMPLES

The following Examples and Comparative Examples further illustrate the present invention in detail but are not to be construed to limit the scope of the present invention.

Production of Solid Center

Each spherical solid center was obtained by mixing the rubber composition for the solid center having the formulation shown in Tables 1 and 2, and press-molding the mixture at the condition shown in the same tables. A diameter, a weight, a surface hardness (a) and a center hardness (b) of the resulting solid center were measured, and a hardness difference (a–b) was determined by calculating from the results. The results are shown in the same Tables. The weight of the solid center was adjusted by an amount of a barium sulfate so that the resulting golf ball has a desired weight.

TABLE 1

| | | (parts by weight) | | | |
|---|---|---|---|---|---|
| Solid center composition | | A | B | C | D |
| BR18 *1 | | 100 | 100 | 100 | 100 |
| Zinc acrylate | | 28 | 28 | 28 | 28 |
| Dicumyl peroxide | | 1.1 | 1.1 | 1.1 | 1.1 |
| Zinc oxide | | 15.3 | 15.3 | 15.3 | 15.3 |
| Barium sulfate | | proper amount | proper amount | proper amount | proper amount |
| Diphenyl disulfide | | 0.5 | 0.5 | 0.5 | 0.5 |
| Vulcanization condition | | | | | |
| The first stage | Temp. (° C.) | 160 | 146 | 160 | 160 |
| | Time (min) | 23 | 18 | 23 | 23 |
| The second stage | Temp. (° C.) | — | 165 | — | — |
| | Time (min) | — | 7 | — | — |
| Diameter of the center (mm) | | 35.8 | 35.8 | 29.0 | 38.5 |
| Weight of the center (g) | | 29.8 | 29.8 | 20.0 | 34.5 |
| Surface hardness of the center a (JIS-C) | | 80 | 76 | 80 | 80 |
| Center hardness of the center b (JIS-C) | | 65 | 75 | 68 | 64 |
| Hardness difference (a–b) | | 15 | 1 | 12 | 16 |

TABLE 2

| | | (parts by weight) | | | |
|---|---|---|---|---|---|
| Solid center composition | | E | F | G | H |
| BR18 *1 | | 100 | 100 | 100 | 100 |
| Zinc acrylate | | 28 | 28 | 28 | 28 |
| Dicumyl peroxide | | 1.1 | 1.1 | 1.1 | 1.1 |
| Zinc oxide | | 15.3 | 15.3 | 15.3 | 15.3 |
| Barium sulfate | | proper amount | proper amount | proper amount | proper amount |
| Diphenyl disulfide | | 0.5 | 0.5 | 0.5 | 0.5 |
| Vulcanization condition | | | | | |
| The first stage | Temp. (° C.) | 155 | 159 | 157 | 148 |
| | Time (min) | 27 | 24 | 25 | 20 |
| The second stage | Temp. (° C.) | — | — | — | 165 |
| | Time (min) | — | — | — | 7 |
| Diameter of center (mm) | | 35.8 | 35.8 | 35.8 | 35.8 |
| Weight of the center (g) | | 29.8 | 29.8 | 29.8 | 29.8 |
| Surface hardness of center a (JIS-C) | | 78 | 79 | 78 | 78 |

TABLE 2-continued

| | (parts by weight) | | | |
|---|---|---|---|---|
| Solid center composition | E | F | G | H |
| Center hardness of center b (JIS-C) | 68 | 65 | 66 | 73 |
| Hardness difference (a–b) | 10 | 14 | 12 | 5 |

*1: High-cis polybutadiene (trade name "BR 18") from JSR Co., Ltd., Content of 1,4-cis-polybutadiene: 96%

Formation of Thread Rubber Layer

Each thread rubber layer was then formed on the solid center by winding the thread rubber to obtain each thread wound core having a diameter of 39.0 mm. The thread rubber was prepared from a blend of natural rubber and a low cis-isoprene rubber ("Shell IR-309" commercially available from Shell Chemical Co., Ltd.)=50/50 (weight ratio).

Preparation of Cover Composition

The formulation materials for the cover shown in Table 3 were mixed using a kneading type twin-screw extruder to obtain pelletized cover compositions. The extrusion condition were a screw diameter of 45 mm, a screw speed of 200 rpm, and a screw L/D of 35.

The formulation materials were heated at 200 to 260° C. at the die position of the extruder. The acid content, content of neutralized carboxyl group, Shore D hardness and flexural modulus of the resulting cover compositions were also shown in the same Table. The flexural modulus was determined according to JIS K7106, using a sample of a heat and press molded sheet having a thickness of about 2 mm from the each composition, which had been stored at 23° C. for 2 weeks. The Shore D hardness was determined according to ASTM D-2240, using a sample of a stack of the three or more sheets described above.

TABLE 3

| | (parts by weight) | | |
|---|---|---|---|
| Cover composition | a | b | c |
| Hi-milan 1605 *2 | 60 | — | 5 |
| Hi-milan 1706 *3 | 40 | — | — |
| Hi-milan 1555 *4 | — | — | 10 |
| Hi-milan 1855 *5 | — | — | 85 |
| Surlyn 8140 *6 | — | 30 | — |
| Surlyn 9120 *7 | — | 70 | — |
| Titanium dioxide | 3 | 3 | 3 |
| Barium sulfate | 1 | 1 | 1 |
| Cover hardness (Shore D) | 65 | 69 | 54 |
| Flexural modulus (MPa) | 273 | 360 | 98 |

*2: Hi-milan 1605 (trade name), ethylene-methacrylic acid copolymer ionomer resin obtained by neutralizing with sodium ion, manufactured by Mitsui Du Pont Polychemical Co., Ltd., MI = 2.8, flexural modulus = about 245 MPa

*3: Hi-milan 1706 (trade name), ethylene-methacrylic acid copolymer ionomer resin obtained by neutralizing with zinc ion, manufactured by Mitsui Du Pont Polychemical Co., Ltd., MI = 0.9, flexural modulus = about 250 MPa

*4: Hi-milan 1555 (trade name), ethylene-methacrylic acid copolymer ionomer resin obtained by neutralizing with sodium ion, manufactured by Mitsui Du Pont Polychemical Co., Ltd., MI = 10.0, flexural modulus = about 160 MPa TABLE 3-continued

| Cover composition | (parts by weight) a | b | c |
|---|---|---|---|

*5: Hi-milan 1855 (trade name), ethylene-methacrylic acid-acrylic acid ester terpolymer ionomer resin obtained by neutralizing with zinc ion, manufactured by Mitsui Du Pont Polychemical Co., Ltd., MI = 1.0, flexural modulus = about 65 MPa
*6: Surlyn 8140 (trade name), ethylene-methacrylic acid copolymer ionomer resin obtained by neutralizing with sodium ion, manufactured by Du Pont Co., MI = 2.6, flexural modulus = about 323 MPa
*7: Surlyn 9120 (trade name), ethylene-methacrylic acid copolymer ionomer resin obtained by neutralizing with zinc ion, manufactured by Du Pont Co., MI = 1.3, flexural modulus = about 242 MPa

Examples 1 to 4 and Comparative Examples 1 to 6

The resulting cover compositions were preliminary molded into semi-spherical half-shells, encapsulating the resulting thread wound core with the two half-shells, followed by press-molding in the mold for golf ball and then coating with a paint to obtain a thread wound golf ball having a weight of 45.4 g and a diameter of 42.8 mm. With respect to the resulting golf ball, the flight performance (launch angle, spin amount, and flight distance) and shot feel were measured or evaluated, and the results are shown in Tables 4 and 5. The test methods are described later.

Comparative Example 7

With respect to a two-piece solid golf ball commercially available from Sumitomo Rubber Industries, Ltd., the flight performance (launch angle, spin amount, and flight distance) and shot feel were measured or evaluated as described above, and the results are shown in Table 5. The test methods are as follows.

Test Method (1) Flight Performance 1

After a No. 1 wood club (W#1, a driver) having metal head was mounted to a swing robot manufactured by True Temper Co. and a golf ball was hit at head speed of 45 m/sec, the launch angle, spin amount and flight distance were measured. The spin amount was determined by measuring backspin amount. The measurement was conducted by continuously taking a photograph of a mark provided on the hit golf ball using a high-speed camera. As the flight distance, carry, which is a flight distance to the firstly dropping point on the ground, was measured.

(2) Shot Feel

The shot feel of the golf ball is evaluated by 10 golfers according to a practical hitting test. The evaluation criteria are as follows.

Evaluation criteria:

○: Not less than 8 out of 10 golfers felt that the golf ball has soft and good shot feel.

Δ: From 3 to 7 out of 10 golfers felt that the golf ball has soft and good shot feel.

xS: Not less than 8 out of 10 golfers felt that the golf ball has too soft and poor shot feel.

xH: Not less than 8 out of 10 golfers felt that the golf ball has too hard and poor shot feel.

Test Results

TABLE 4

| Test item | Example No. 1 | 2 | 3 | 4 | Com. Example No. 1 |
|---|---|---|---|---|---|
| Center composition | A | A | F | G | A |
| Cover composition | a | b | a | a | c |
| Flight performance | | | | | |
| Launch angle (degree) | 9.9 | 10.0 | 9.9 | 9.8 | 9.5 |
| Spin amount (rpm) | 3000 | 3000 | 3000 | 3050 | 3400 |
| Carry (yard) | 217 | 218 | 217 | 216 | 209 |
| Shot feel | ○ | ○ | ○ | ○ | xS |

TABLE 5

| Comparative Example No. | 2 | 3 | 4 | 5 | 6 | 7 |
|---|---|---|---|---|---|---|
| Center composition | B | C | D | E | H | * |
| Cover composition | a | a | a | a | a | |
| Flight performance | | | | | | |
| Launch angle (degree) | 9.5 | 9.6 | 9.8 | 9.7 | 9.6 | 10.2 |
| Spin amount (rpm) | 3350 | 3300 | 3200 | 3100 | 3300 | 2800 |
| Carry (yard) | 210 | 210 | 209 | 214 | 212 | 215 |
| Shot feel | xH | ○ | xH | Δ | xH | xH |

*: Two-piece solid golf ball commercially available from Sumitomo Rubber Industries, Ltd.

As is apparent from Table 4 to Table 5, the thread wound golf balls of Examples 1 to 4 of the present invention had longer flight distance than the conventional thread wound golf balls of Comparative Examples, and particularly had longer flight distance than the commercially available two-piece solid golf ball of Comparative Example 9. In addition, the thread wound golf balls of Examples 1 to 4 of the present invention also had soft and good shot feel.

On the other hand, in the golf ball of Comparative Example 1, the hardness and flexural modulus of the cover is low, and the rebound characteristics are not only degraded but the spin amount is also high, which reduces the flight distance. In addition, the shot feel is too soft and poor. In the golf ball of Comparative Example 2, the difference between the surface hardness and center hardness of the solid center is small, and the launch angle is low and the spin amount is high, which reduces the flight distance.

In the golf ball of Comparative Example 3, the diameter of the solid center is small, and the spin amount is high, which reduces the flight distance. In the golf ball of Comparative Example 4, the diameter of the solid center is large, and the thread rubber layer is too thin. Therefore the rebound characteristics as the technical effects of the thread rubber layer do not sufficiently exhibit, which reduces the flight distance.

In the golf ball of Comparative Example 5, the difference between the surface hardness and center hardness of the solid center is small, and the launch angle is low and the spin amount is high, which reduces the flight distance. In addition, the shot feel is also poor when compared with the golf balls of Examples. In the golf ball of Comparative Example 6, the difference between the surface hardness and center hardness of the solid center is small, and the launch angle is low and the spin amount is high, which reduces the flight distance.

What is claimed is:

1. A thread wound golf ball comprising a solid center, a thread rubber layer formed on the solid center, and a cover covering the thread rubber layer, wherein the solid center has a diameter of 30 to 38 mm and a surface hardness in JIS-C hardness of 65 to 90, the surface hardness is higher than a center hardness in JIS-C hardness of the solid center by not less than 12, the cover is formed from a base resin mainly comprising ionomer resin, and has a flexural modulus of 200 to 600 MPa and a Shore D hardness of 60 to 80.

* * * * *